United States Patent [19]

Ashworth

[11] 4,179,010

[45] Dec. 18, 1979

[54] ACCESS EQUIPMENT

[75] Inventor: Denis H. Ashworth, Sedgley, England

[73] Assignee: Simon Engineering Dudley Limited, West Midlands, England

[21] Appl. No.: 853,414

[22] Filed: Nov. 21, 1977

[30] Foreign Application Priority Data

Dec. 14, 1976 [GB] United Kingdom ..... 52209/76

[51] Int. Cl.[2] ..... B66F 11/04

[52] U.S. Cl. ..... 182/2; 212/144

[58] Field of Search ..... 182/2; 212/144, 17

[56] References Cited

U.S. PATENT DOCUMENTS

| | | | |
|---|---|---|---|
| 3,149,694 | 9/1964 | Smithee | 182/2 |
| 3,834,488 | 9/1974 | Grove | 182/2 |
| 3,937,340 | 2/1976 | Grove | 182/2 |

*Primary Examiner*—Reinaldo P. Machado

*Attorney, Agent, or Firm*—Norris & Bateman

[57] ABSTRACT

An accessory for converting a crane of the kind having a telescopically extendible jib pivotally connected to a turntable into access equipment comprising a unit to be fitted to the free end of the jib of the crane, a bracket member pivotally connected to said unit for rotation about a horizontal axis, first hydraulic cylinder means extending between said unit and the bracket and capable of being actuated to adjust the orientation of said bracket relative to the jib of the crane, a boom structure pivotally connected relative to said bracket for movement in a vertical plane about a horizontal axis, a working platform or cage pivotally connected to the end of said boom structure remote from said bracket, second hydraulic cylinder means for causing pivotal movement of said boom structure relative to said bracket and means for maintaining said working platform or cage level regardless of the angle of inclination of said boom structure.

2 Claims, 3 Drawing Figures

ACCESS EQUIPMENT

This invention concerns an accessory for converting a crane of the kind (hereinafter termed of the kind referred to) having a telescopically extendible jib pivotally connected to a turntable into access equipment for giving an operator access to a variety of elevated positions.

According to the present invention, an accessory for converting a crane of the kind referred to into access equipment comprises a unit adapted to be fitted to the free end of the jib of the crane, a bracket member pivotally connected to said unit for rotation about a horizontal axis, first hydraulic cylinder means extending between said unit and the bracket and capable of being actuated to adjust the orientation of said bracket relative to the jib of the crane, a boom structure pivotally connected relative to said bracket for movement in a vertical plane about a horizontal axis, a working platform or cage pivotally connected to the end of said boom structure remote from said bracket, second hydraulic cylinder means for causing pivotal movement of said boom structure relative to said bracket, and means for maintaining said working platform or cage level regardless of the angle of inclination of said boom structure.

The invention will be further apparent from the following description with reference to the figures of the accompanying drawings which show, by way of example only, a number of accessories embodying the invention for use with a crane of the kind referred to.

Figure 3:
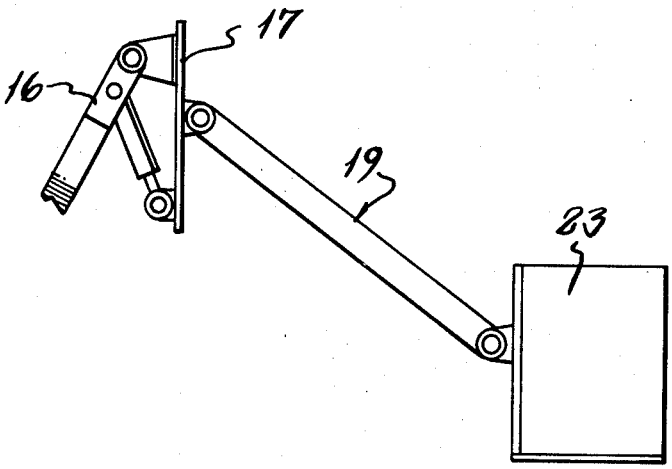

and FIG. 3 shows a still further form of accessory.

Figure 1:
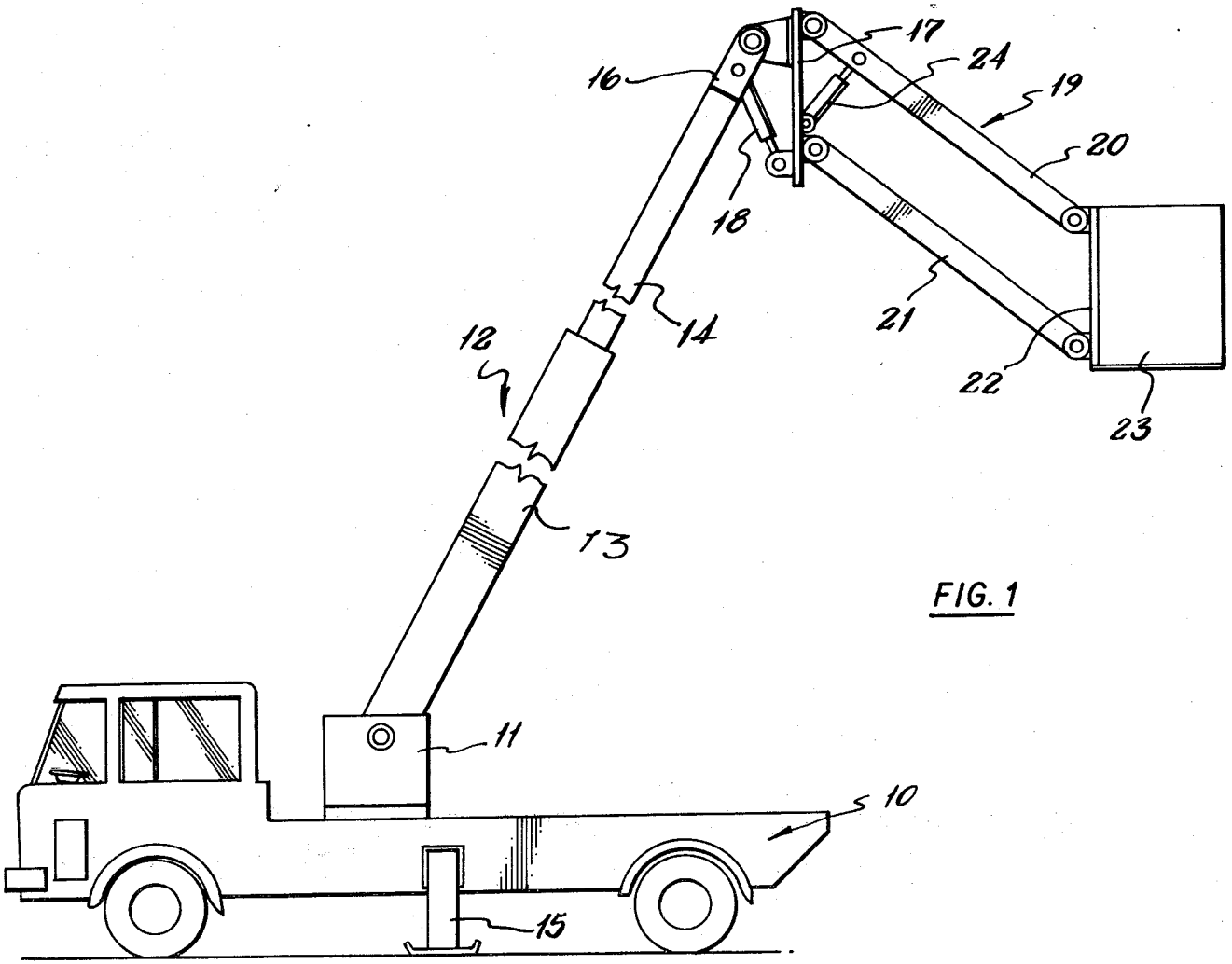
FIG. 1 shows a side elevation of a crane of the kind referred to fitted with a first form of accessory.

Referring now to FIG. 1 of the drawings, it will be seen that the crane is comprised by a vehicle 10 whose chassis mounts a turntable 11 which can be rotated about a vertical axis by hydraulic motor means of known kind.

The crane jib generally indicated at 12 comprises, in this example, a first section 13 which is pivotally connected to the turntable 11 for movement about a horizontal axis and a second section 14 which is telescopically extendible from the first section 13. Hydraulic actuator means is provided for pivoting the jib from a first stowed position wherein it extends horizontally or substantially so and an elevated position wherein the jib makes a desired angle relative to the horizontal up to as much as 90°. Further hydraulic actuator means is provided to enable the section 14 to be extended from or retracted into the section 13 to a desired extent.

The vehicle 10 is equipped with hydraulically extendible and retractable ground engaging stabilising jacks 15 to ensure stability when the jib 12 is in an elevated position.

The first form of accessory is essentially comprised by a unit 16 which can be fitted to the free end of the jib 12 by means of bolts, clamps or other suitable mechanical means in place of or adjacent the pulley assembly normally provided at the free end of the jib.

A bracket member 17 is provided and pivotally connected to the unit 16 for rotational movement relative thereto about a horizontal axis. A double-acting hydraulic ram 18 extends between the unit 16 and bracket 17 and is capable of being actuated to maintain the bracket 17 in a vertical or substantially vertical position regardless of the angle of inclination of the jib 12. A boom generally indicated at 19 extends outwardly from the bracket 17 and is comprised by upper and lower beams 20 and 21 lying in a common vertical plane and each pivotally connected to the bracket 17 for movement about horizontal axes. The beams 20 and 21 are connected by a member 22 at their ends remote from the bracket 17 and each is pivotally connected with the member 22 for movement relative thereto about a horizontal axis. The arrangement is such that the bracket 17, a member 22 and beams 20 and 21 form a parallelogram linkage, the member 22 always being oriented in the same direction as the bracket 17.

The member 22 supports a working platform or cage 23 adapted to hold at least one workman or operator.

An hydraulic ram 24 extends between the bracket 17 and upper beam 20 and can be operated to cause the boom 19 to pivot in a vertical plane relative to the bracket 17. Throughout such pivoting movement the working platform or cage 23 will maintain a horizontal attitude provided the ram 18 has been operated to set the bracket 17 in a vertical direction for a particular angle of inclination of the jib 12.

In use the jib 12 can be lowered to bring the working platform or cage 23 to a position at or adjacent ground level to receive an operator. The jib is then raised to a desired angle and as it is raised the ram 18 is operated to maintain the cage 23 level. For any particular inclination of the jib 12 the operator can have access to a variety of positions by adjustment of the angle of inclination of the boom 19 and by rotating the turntable 11 to cause the working platform or cage 23 to move along a circular path.

Frequently the preferred position for the jib when the accessory is in use will be such that it extends vertically or substantially so, thus enabling the operator to reach a maximum height. The accessory can, however, be used with the jib in other positions where outreach from the position of the vehicle 10 will be greater.

Preferably the ram 18 will be operated automatically by hydraulic valve means in response to movement of the jib 12 so as always to maintain the bracket 17 in a vertically aligned position as shown in the drawing. Alternatively, however, means may be provided to enable a workman in the cage 23 to operate the ram 18 by means of a manually operable valve to maintain the bracket 17 in a vertical or substantially vertical disposition.

Figure 2:
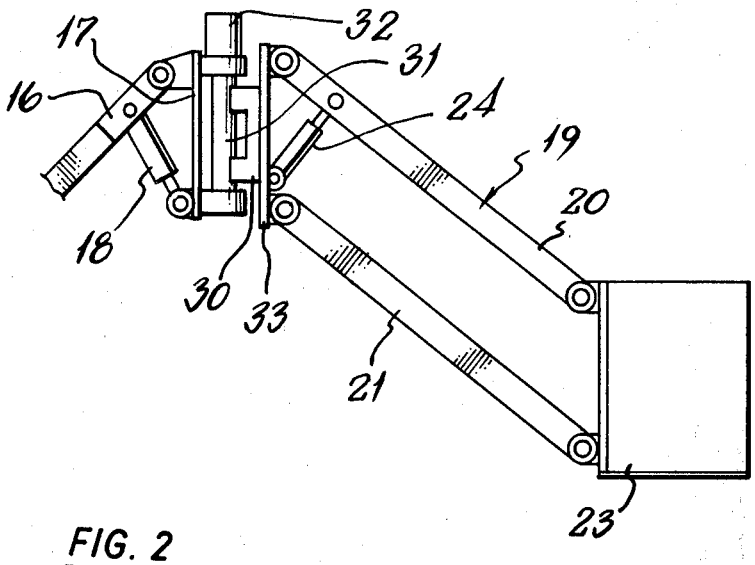
FIG. 2 shows an alternative form of accessory.

Referring now to FIG. 2, it will be seen that the accessory may be modified in that the bracket is formed in two parts. The first part 17 is connected with the unit 16 and mounts a member 30 connected with a vertical shaft 31 capable of being rotated by means of a motor 32, which member 30 is secured to the second part of the bracket 33 to which the beams 20 and 21 are pivotally connected. In this arrangement a workman can move the working platform or cage 23 along a circular path whose centre is approximately coincident with the upper end of the jib 12, thus giving an additional freedom of movement for access to a variety of positions.

As may be seen from FIG. 3, the boom 19 may be comprised by a single beam rather than two spaced beams. In this arrangement, however, additional means of known kind including ropes or chains is required to maintain the working platform or cage 23 level regardless of the angle of inclination of the boom structure 19.

It will be appreciated that it is not intended to limit the invention to the above examples only, many variations, such as might readily occur to one skilled in the art, being possible without departing from the scope thereof as defined in the appended claims.

Thus, for example, the accessory may be arranged such that the boom extends on the opposite side thereof from that shown in the drawings whereby the working platform or cage 23 can be positioned directly above the turntable 11.

What is claimed is:

1. In a crane of the kind having a telescopically extendible jib pivotally connected at one end to a turntable, an accessory unit to be fitted to the free end of the jib of the crane, a bracket pivotally connected to said unit for rotation about a horizontal axis, first hydraulic cylinder means extending between said unit and the bracket and capable of being actuated to adjust the orientation of said bracket relative to the jib of the crane, said bracket comprising a bracket member having on one side means at its upper end for directly pivotally connecting it to said unit and lower vertically spaced means for directly pivotally connecting it to one end of said first hydraulic cylinder means which has its other end pivoted on said unit, said bracket being formed in two parts, one of which is said bracket member and the other of which is a spaced member to which the boom structure is pivotally connected, and there being means in said bracket for relatively pivoting said members about a vertical axis, a boom structure pivotally connected relative to said bracket for movement in a vertical plane about a horizontal axis, a working platform or cage pivotally connected to the end of said boom structure remote from said bracket, second hydraulic cylinder means for causing pivotal movement of said boom structure relative to said bracket and means for maintaining said working platform or cage level regardless of the angle of inclination of said boom structure.

2. A crane according to claim 1 wherein said boom structure is comprised by two beams each pivotally connected to said bracket so as to lie one above the other in a vertical plane and also each pivotally connected to a connecting member at their ends remote from the bracket, the working platform or cage being secured to said connecting member, the bracket, beams and connecting member forming a parallelogram linkage assembly whereby the working platform or cage maintains a constant attitude in space relative to the bracket regardless of the angle of inclination of the boom structure.

* * * * *